US005491416A

United States Patent [19]

Klimstra et al.

[11] Patent Number: 5,491,416

[45] Date of Patent: Feb. 13, 1996

[54] METHOD AND DEVICE FOR THE MEASURING AND MONITORING OF ELECTRICAL SPARK GAPS DURING OPERATION

[75] Inventors: Jacob Klimstra, Twijzel; Abraham De Voogd, Rotterdam, both of Netherlands

[73] Assignee: Deltec Fuel Systems B.V., Netherlands

[21] Appl. No.: 185,990

[22] PCT Filed: Jul. 17, 1992

[86] PCT No.: PCT/NL92/00132

§ 371 Date: Jan. 13, 1994

§ 102(e) Date: Jan. 13, 1994

[87] PCT Pub. No.: WO93/02286

PCT Pub. Date: Feb. 4, 1993

[30] Foreign Application Priority Data

Jul. 17, 1991 [NL] Netherlands ..... 9101257

[51] Int. Cl.[6] ..... F02P 17/12

[52] U.S. Cl. ..... 324/393; 324/399

[58] Field of Search ..... 324/393, 394–402, 324/403; 73/116, 117.3, 118.1

[56] References Cited

U.S. PATENT DOCUMENTS

| | | | |
|---|---|---|---|
| 3,961,240 | 6/1976 | Pohl | 324/399 |
| 4,004,213 | 1/1977 | Kato et al. | 324/399 |
| 4,008,430 | 2/1977 | Blum | 324/402 |
| 4,024,469 | 5/1977 | Bobulski | 324/399 |
| 4,558,280 | 12/1985 | Koehl et al. | 324/399 |
| 4,825,167 | 4/1989 | Bayba | 324/399 |
| 5,208,541 | 5/1993 | Yerkovich et al. | 324/395 |

FOREIGN PATENT DOCUMENTS

| | | |
|---|---|---|
| 602200 | 9/1934 | Germany . |
| 1372280 | 10/1974 | United Kingdom . |

*Primary Examiner*—Sandra L. O'Shea
*Assistant Examiner*—J. M. Patidor
*Attorney, Agent, or Firm*—Bachman & LaPointe

[57] ABSTRACT

Spark gap measuring and monitoring method and device, for providing, during operation, a signal indicative of the intended performance of the spark gap (1), in particular a spark plug of a combustion engine. The device includes an electrical detecting element which is coupled inductively to a connecting lead (4) of the spark gap (1), for example a toroidal coil (8), which detecting element is connected to a processing circuit (9–11) for the purpose of converting the electrical signal produced by the detecting element into a measuring signal indicative of the spark gap (1) performance, for example the spacing (d) between the electrodes (2, 3). Measurement results obtained from an initial measurement can be established as reference data by means of memory elements and circuit elements. The measuring signal is then analyzed by means of an analyzing circuit (14) as a function of the reference data.

17 Claims, 3 Drawing Sheets

METHOD AND DEVICE FOR THE MEASURING AND MONITORING OF ELECTRICAL SPARK GAPS DURING OPERATION

BACKGROUND OF THE INVENTION

The invention relates to a method and device for monitoring, during operation, the performance of an electrical spark gap, in particular a spark plug of a combustion engine, which is connected to a device for generating electrical high voltage, the current arising during the flashover of the spark gap being detected, converted into a measuring signal representative of the instantaneous operational state of the spark gap, and analyzed.

Electrical spark gaps are in practice most commonly used for igniting or initiating the ignition of a combustion process, for example the ignition of gas-fuelled boilers or heating stoves or the combustion process of the so-called spark-ignition engines (petrol and gas engines according to the Otto principle). Spark gaps for use in combustion engines are generally known under the name spark plug.

Each spark causes wear of the electrodes, which increases the distance or gap between the electrodes. Because the electrical high voltage generated is limited in amplitude in practical systems, flashover between the electrodes will no longer occur beyond a certain spacing or gap size. Adjustment of the electrode spacing or replacement of the spark gap or spark plug, respectively, is then necessary. For the sake of an undisturbed and efficient combustion process it is also necessary to keep the gap size within certain limits.

Until now, establishing the time when a spark plug has to be replaced or adjusted has, in practice been done either periodically, possibly in combination with an inspection, or on the basis of detecting a failure, for example cylinder failure in a combustion engine. A periodical inspection is time-consuming and consequently expensive. Because of electrode fouling, it is, moreover, difficult to establish optically to what extent a spark plug is worn. A very serious drawback is the fact that, for the purpose of said inspection, the process controlled by the spark gap or spark plug has to be stopped and the spark plugs have to be removed. This applies particularly to combustion engines working continuously or stationarily, for example for the purpose of driving electrical generators, in which case stopping the process controlled by the engines, that is to say the interruption of the generation of energy, can be economically very disadvantageous.

U.S. Pat. No. 4,558,280 discloses a method and device for monitoring during operation, the spark plugs of a combustion engine, in which method and device the spark plug current arising during the flashover is detected. The measured current is converted into a measuring signal representative of the instantaneous operational state of the spark plug by means of an electronic processing circuit. For the purpose of determining the performance of a spark plug, a comparative measurement is performed, the measuring signal from the spark plug in question being compared with the instantaneous average of the measuring signals of all the spark plugs.

This measurement method however only makes it possible to detect whether the spark plug in question deviates, with regard to performance, from the average of all the other spark plugs. Checking the instantaneous operational state of the spark plugs relative to a calibration value is not possible by this method. In essence, only fault detection can be carried out using the method and circuit according to this US patent. Aging of the spark plugs, a change in the electrode spacing relative to the spacing at installation, and the like, cannot be detected, nor is the device suitable for monitoring one single spark gap, for example in a boiler or the like.

U.S. Pat. No. 4,825,167 describes a device and method for the testing of spark plugs under simulated operational conditions. In this case, too, the current in the spark plug during flashover therein is detected, and the measuring signal subsequently being compared to predetermined reference data, and any fault signal is thereby produced.

In addition to the disadvantage of testing under simulated operating conditions, for which purpose the process controlled by the spark plug has to be interrupted, this method has the practical drawback that it requires the previous introduction of reference data. These reference data may, however, vary from engine to engine and as a function of the type of the spark plug used. Extensive management of reference data is therefore required, and the possibility of mistakes in introducing these reference data, and as a consequence, the taking of wrong decisions is by no means inconceivable.

SUMMARY OF THE INVENTION

The object of the invention, therefore, is to provide a method and a device which are readily applicable in practice and which make it possible to monitor, during operation, the intended performance of a spark gap, in particular a spark plug of a combustion engine, without first having to determine and introduce reference data.

The method according to the invention is characterized by the following steps:

establishing reference data representing the performance of the spark gap from the measuring signal obtained during an initial measurement, analyzing the measuring signal as a function of the reference data, and signalling discrepancies, resulting from the analysis step, between the measuring signal and the reference data.

In contrast to the prior art, the method according to the invention makes it possible to check the instantaneous performance of the spark gap against its intended performance, in order to signal discrepancies between them. By establishing the reference data from the measuring signal obtained during an initial measurement of the spark gap, it is no longer necessary to establish and introduce the reference data separately and the abovementioned risk of errors is effectively eliminated. Because, in the case of the method according to the invention, it is actually no longer required to introduce data, this method is easy to apply in practice and can be applied by untrained users. The reference data can, for example, be established during a first measurement after the spark gap has been installed.

BRIEF DESCRIPTION OF THE DRAWINGS

The invention is explained in the accompanying drawings by reference to a block diagram of an embodiment of the processing circuit and to several measurement results shown in the form of diagrams, wherein.

DETAILED DESCRIPTION OF PREFERRED EMBODIMENTS

Figure 1:
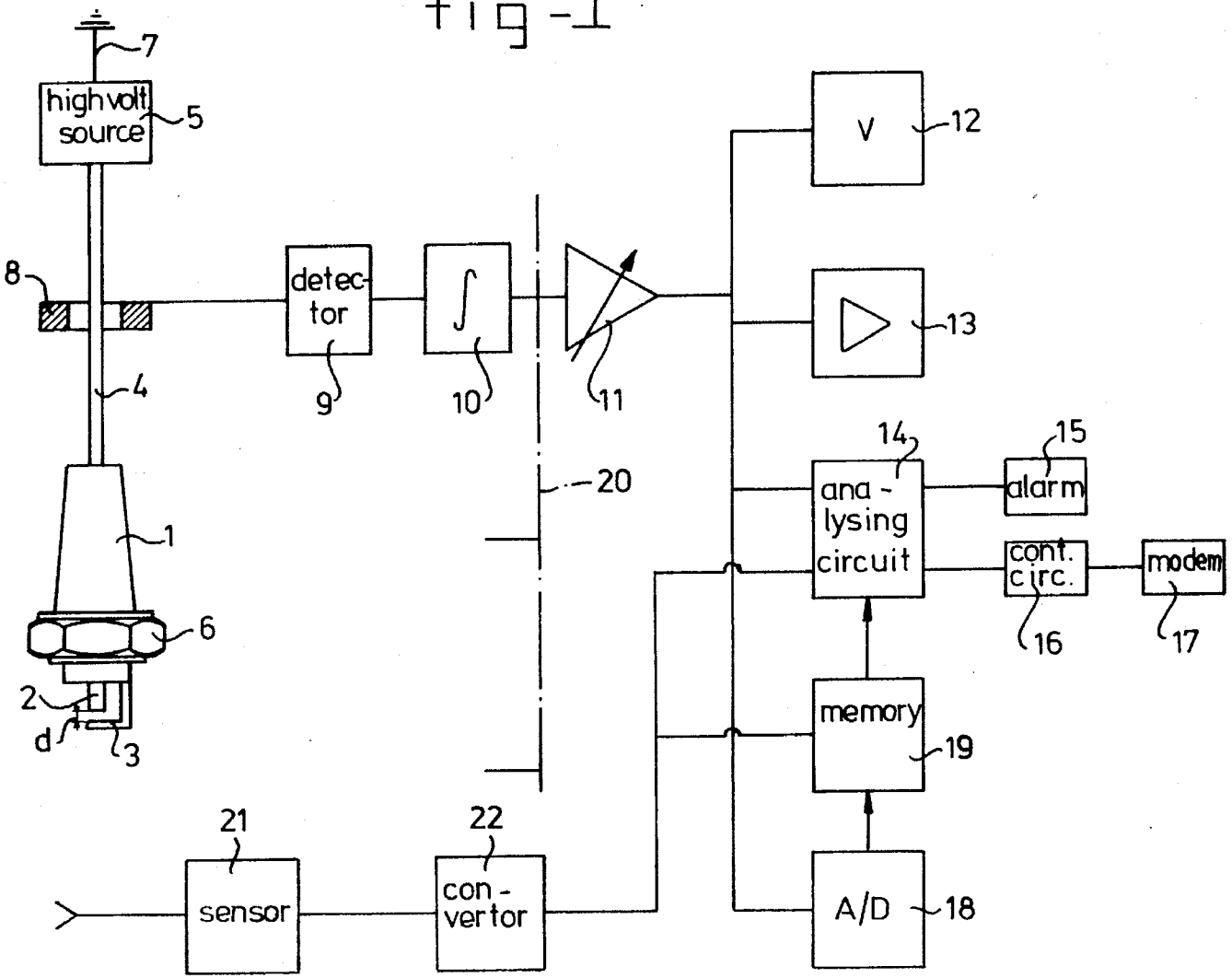
FIG. 1 shows the block diagram of an embodiment of a processing circuit according to the invention, used with a spark plug for a combustion engine.

In general, the current through the spark gap during flashover between the electrodes is a function of the process controlled by the spark gap. To prevent incorrect interpretations of the performance of the spark gap as a consequence of altered operating conditions, in the case of a further embodiment of the method according to the invention, the measuring signal is analyzed as a function of the operating conditions of the spark gap. The reference data can be established for a single, clearly defined, operating state of the spark gap, or for a number of operating states.

If the spark gap is, for example, a spark plug in a combustion engine, the measuring signal as a function of the engine load can be analyzed by determining a parameter from a measurement of the instantaneous engine load, and by selecting or converting the stored reference data as a function of the engine load with the help of said parameter. Furthermore, with the help of the parameter determined from the measured instantaneous engine load, it is possible to convert the measuring signal to an engine load corresponding to the reference data, such as, for example, the zero load state of the engine.

In practice, it is virtually always desirable to monitor the spacing between the electrodes of a spark gap. In a preferred embodiment of the method according to the invention, this is achieved as such in that a measuring signal is provided which corresponds to the average instantaneous peak value of the current in the spark gap, the reference data comprising a value corresponding to the electrode spacing of the spark gap, and a signal indicative of the deviation of the instantaneous electrode spacing compared to the reference distance being provided by comparing the measuring signal and the reference data.

The invention relates also to a device for monitoring, during operation, the performance of an electrical spark gap, in particular a spark plug of a combustion engine, which is connected to a device for generating electrical high voltage, comprising means for the detection of the current arising during the flashover of the spark gap, an electrical processing circuit for converting the current detected into a measuring signal representative of the instantaneous operating state of the spark gap and means for analyzing the measuring signal, characterized by means for providing reference data representing the performance of the spark gap from an initial measurement, means for recording the reference data, and wherein the means for the analysis of the measuring signals are designed for the signalling of discrepancies between the measuring signal and the reference data.

Electronic means suitable for establishing the reference data are known per se in practice. Preferably use is made of digital means in the form of volatile or non-volatile programmable memories. The means for analyzing the measuring signal may, inter alia, comprise comparators, threshold value circuits etc. for the purpose of, for example, comparing the measuring signal with the reference data in order to detect deviations above or below a threshold value. These functions can also be advantageously implemented by means of a microprocessor.

A further embodiment of the device according to the invention is provided with means for supplying a parameter corresponding to the instantaneous operating conditions under which the spark gap operates, which means are coupled to the means for analyzing the measuring signal, in order to analyze the measuring signal as a function of said parameter. With the help of the parameter obtained in this manner, either the measuring signal can be converted to the operational conditions under which the reference data are obtained, or vice versa the reference data can be transformed to the instantaneous operating conditions, in order to effect monitoring of the performance of the spark gap, which monitoring is adapted to the instantaneous operational conditions.

According to yet another embodiment of the invention, the means for recording the reference data can be designed in such a manner that the data in question are established as a function of the operating conditions of the spark gap. In the case of a digital memory, the parameter which is derived from the instantaneous operating conditions of the spark gap can then be used as address information for the selection of the reference value or reference values for the analysis of the measuring signal.

It is known that the electrical voltage required for flashover between the electrodes of a spark gap is a measure for the electrode spacing or gap size. Sensors which are known in practice and which are to be connected in an electrically conducting manner to the terminal lead of the spark gap are large in size, partly as a consequence of the electrical insulation required for the high voltage used, and are therefore expensive and essentially only suitable for laboratory purposes. Capacitive sensors are sensitive to interference and produce signals which are too small (low signal-to-noise ratio). The use of resistance bridges as voltage dividers is also expensive as a consequence of the high-voltage resistors required. Instead of an electrically conducting or capacitive coupling for the measurement of the flashover voltage, an electrical sensor which is coupled inductively to a terminal lead of the spark bridge is to be preferred.

The instantaneous peak current during flashover between the electrodes is a measure for the size of the spacing or gap between them. The relationship between the peak value of the current and the flashover voltage can be understood as follows.

As the spacing between the electrodes increases, flashover occurs at a higher voltage, provided the ambient conditions or operating conditions of the spark gap (pressure, temperature) remain constant. Because the resistance between the electrodes during complete flashover is virtually independent of the electrode spacing, the size of the instantaneous peak current during flashover is virtually proportional to the flashover voltage and therefore to the electrode spacing of the spark gap. The currents which occur in the terminal lead of the spark gap are, in the device according to the invention, preferably detected in an inductive manner and further processed to provide a signal representative for the distance between the electrodes. In this way, it is sufficient to use an electrical detector without special requirements with regard to electrical insulation against high voltage and therefore without the accompanying disadvantageous effect on the physical size and the cost of the sensor.

In an embodiment of the device according to the invention, the means for detecting the current through the spark gap comprise an electrical sensor which is coupled inductively to a terminal lead of the spark gap, the processing circuit comprising, as the first stage, a peak-value detector having an integrator circuit connected downstream of said first stage for the purpose of providing a measuring sisal which corresponds to the average instantaneous peak value of the detector signal, said measuring sisal being in the form of an electrical voltage corresponding to the electrode spacing of the spark gap.

For the purpose of determining the spacing between the electrodes of the spark gap, the average instantaneous peak value of the flashover voltage, or of the current, is importer. The rate at which, for example, electrodes of a spark plug will wear is so slow that a response time in the order of magnitude of several tens of seconds is sufficient to obtain a sisal which is representative of the existing electrode spacing. Apart from the fact that, because of this low frequency behavior it is sufficient to use a processing circuit constructed from relatively cheap electrical components, short interference pulses, partly caused by the stochastic ignition process, do not affect the measurement result.

In the preferred embodiment of the device according to the invention, the sensor comprises an electrical toroidal coil disposed around the terminal lead. The peak voltage generated in this the of coil is in theory directly proportional to the peak value of the current variation in the terminal lead per unit time. Because a coil, besides certain self-induction, also has an electrical resistance and capacitance, rapid changes in current such as those occurring during flashover of a spark gap will not result in an equally rapid rise or fall of the voltage generated in the coil. It has, however, been found that this does not affect the fact that the peak value of the voltage generated in the coil is a measure of the spacing between the electrodes. Besides the advantage of the electrical isolation between the high voltage part and the measuring part, that is to say the electrical processing circuit, use can be made of the commercially available electrical induction coils, which has a very beneficial impact on the cost of the device.

It will be clear that the processing circuit measuring signal corresponding to the sensor signal can be used in many ways and for many purposes.

Yet another embodiment of the device according to the invention comprises means for providing an analog or digital output signal corresponding to the measuring signal.

An embodiment of the device according to the invention which is very suitable for monitoring purposes, comprises means for providing, on the basis of the output signal, a display which varies linearly with the electrode spacing. A display of this type, for example in the form of a column whose height varies in proportion to the spacing between the electrodes, provides an excellent visual indication, in particular for the purpose of monitoring a plurality of spark plugs of a plurality of combustion engines working continuously. Voltmeters or other display instruments of this type are known per se in practice or can be implemented by means of, for example, LED displays or LCD displays.

For monitoring purposes in particular it is expedient for the device, according to an embodiment of the invention, to be provided with a monitoring circuit producing a signal if the output signal exceeds, or falls below, one or more predetermined values. The signal produced by the monitoring circuit may for example be used for activating an alarm or even for switching off immediately, for example, a combustion engine in order to prevent engine damage.

For the purposes of analysis it is expedient to provide an analog electrical signal as input to a recording device. Means suitable for this purpose are known in practice, for example an instrumentation amplifier.

In order to enable remote monitoring and/or processing by means of a personal or host computer it is expedient to provide for a digital output signal. By means of, for example, a modem, information can be transmitted to a remote monitor or control station, or switching functions can be performed from a distance. The means of providing the digital output signal may comprise A/D converters known per se.

In the case of yet another embodiment of the device according to the invention for the purpose of monitoring one or more spark plugs in a combustion engine, each spark plug is provided with separate means for detecting the current occurring during flashover of the spark plug in question, and with an electrical processing circuit for providing a corresponding measuring signal. This is not the case in the abovementioned US patents in which the electrical processing circuit is used in common for all the spark plugs. The device according to the invention is therefore, in contrast to the prior art, not restricted to use in combustion engines with a distributor.

The use of the device according to the invention for measuring and/or monitoring the wear of the electrodes of one or more spark plugs in a combustion engine operating stationarily is of particular interest.

In the block diagram shown in FIG. 1, a spark gap is shown reproduced in the form of a spark plug 1 of a combustion engine, said spark gap comprising a first electrode 2 and a second electrode 3, between which there is a certain electrode spacing or gap d. The first electrode 2 is connected to a high-voltage source 5 via an electrically insulated single wire lead 4. High-voltage sources used in practice usually comprise an induction coil which is connected to a direct voltage source, such as a battery, via a contact breaker. The required high voltage is obtained by interrupting the excitation on the primary side of the induction coil, which causes a high induction voltage on the secondary side of the coil. Other high-voltage sources comprise a capacitor which is charged to a high voltage by a thyristor and a high voltage transformer. The second electrode 3 is connected to the chassis connection 6 of the spark plug, which chassis connection during operation is connected to the chassis connection 7 of the high-voltage source 5. If a suitable high voltage is applied between the first and second electrodes 2, 3, flashover will occur causing a spark which is capable of igniting a combustion process. Spark gaps or spark plugs for this purpose are generally known per se in practice.

The processing circuit comprises a sensor in the form of a toroidal coil 8 which is connected to the input of a peak-value detector 9. The coil 8 surrounds the terminal lead 4 from the high-voltage sources 5 to the spark plug 1, i.e. the first electrode 2, respectively. The signal of the peak-value detector 9 is supplied to an integrator circuit 10, followed by an amplifying circuit 11, preferably an amplifying circuit whose gain can be adjusted, for the purpose of compensating for tolerance differences in the sensors or the coil 8, or for the purpose of connecting sensors with different properties, or for the purpose of adjustment to the properties of the particular ignition system, the high-voltage source 5 and the spark gap or spark plug 1.

The measuring signal at the output of the amplifying circuit 11 is supplied to a voltmeter or LED display 12. Additionally an analog electrical output signal is provided for the purpose of supply to a recording device such as a pen recorder, for example via an instrumentation amplifier 13. The amplifier 13 should supply sufficient energy to control one or more recording devices.

Connected to the output of the amplifying circuit 11 there is also an analyzing circuit 14, for example in the form of one or more comparators, for the purpose of comparing one or more predetermined reference levels of the output signal of the amplifying circuit 11. These reference levels are set as a function of a respective electrode spacing d, such that exceeding or falling below this distance can be signalled by means of an alarm signal 15, for example in the form of an optical or acoustic signal. Furthermore, a control circuit 16 is connected to the output of the analyzing circuit 14, for example for the purpose of issuing control commands to the installation in which the spark plug 1 is used. Such control commands may include switch-off commands for a combustion engine in case of failure of the spark plug 1. The control signals or alarm signals can be transmitted by means of a modem 17, for example via a telephone line. Additionally an analog/digital converter 18 connected to the amplifying circuit 11 is provided for input to a digital processing unit, such as a personal or host computer.

Coupled to the A/D converter 18 there are means 19 in the form of a digital memory and circuit elements, for the purpose of establishing the measuring signal of the amplifier 11 as reference signal during an initial measurement. The circuit elements may be designed for establishing the reference data manually or automatically. The output of the means 19 is coupled with the analyzing circuit 14, for the purpose of analyzing the instantaneous measuring signal of the amplifier 11 using the established reference data.

The dot-dash line 20 indicates schematically that the circuits 11 to 19 inclusive can be used in common for a plurality of spark gaps, which spark gaps are then each provided with a separate coil 8, a peak-value detector 9 and an integrator circuit 10. Suitable circuits or multiplexers known for this purpose are in practice known per se.

The reference number 21 indicates means for the purpose of measuring the operating conditions under which the spark gap or the spark plug 1 are working. In the case of a combustion engine this may be a device for measuring the engine load. Other parameters which can be measured are, for example, the compression and temperature in the cylinders of the engine etc. Preferably, in the case of the means 21, sensors are used which provide an electrical signal. This signal is then converted by means of an electronic circuit 22 into one or more parameters corresponding to said operating conditions and supplied to the analyzing circuit 14 and/or the means 19, for the purpose of analyzing the instantaneous measuring signal as a function of said parameter or parameters, and/or the purpose of selecting the reference data in question.

It will be clear that a number of the circuits described is optional, depending on the purpose for which the device according to the invention is used. For monitoring purposes it is expedient to construct the voltmeter 12 as a bar voltmeter, the height of the bar being a measure for the instantaneous electrode spacing d of spark plug 1. In a practical embodiment of the processing circuit according to the invention, use is made for this purpose of a 16-element LED array, controlled by means of an integrated circuit of the type UAA170, manufactured by Siemens A. G. Obviously a standard analog or digital voltmeter can also be used. The analyzing circuit 14 has been constructed with the help of comparators of the type LM339, manufactured by National Semiconductor Corporation, a lower and upper limit for the electrode spacing d being set. The analyzing circuit 14 comprises a latch for triggering an optical or acoustic element 15 (for example a lamp and/or a buzzer). The output signal of the latch in this case also serves for triggering the control circuit 16, for example in the form of a transistor. In the case of the modem 17, the A/D converter 18, the memory and circuit elements 19 and, for example, the instrumentation amplifier 13, circuits or devices known in practice can be used.

In a practical embodiment, the peak-value detector 9 is constructed as a rectifying circuit around an operational amplifier of the type TL062, manufactured by Texas Instruments Inc. The integrating circuit 10 and the amplifying circuit 11 are in this case combined around a similar operational amplifier of the type TL062. The response time of the integrating circuit is in the order of magnitude of 0.1 seconds. The coil 8 in this case is a commercially available coil having an inductance of about 25 μH and a resistance of 100 mΩ.

As already discussed in the introduction, the voltage induced in coil 8 is a measure of the peak current in the terminal lead 4 of the high-voltage source 5 to spark plug 1, which induced voltage is converted, via the peak-value detector circuit 9 and the integrator circuit 10, to a mean value of the instantaneous peak voltage at flashover between the electrodes 2, 3.

Figure 2:
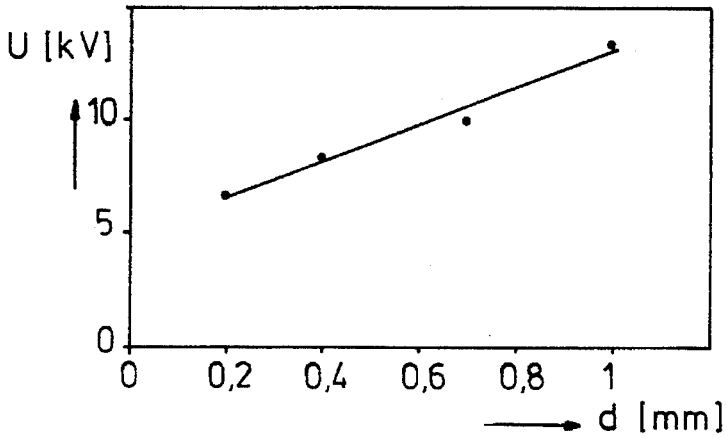
FIGS. 2 to 6 show diagrams of measurement results.

FIG. 2 shows diagrammatically the relationship between the voltage U in kV (abscisss) and the electrode spacing d in mm (ordinate) in the case of a test cylinder supplied with nitrogen gas at a pressure of 5 bar. As can be seen clearly from this diagram, there is a virtually linear relationship (correlation 0.99) between the changes in the electrode spacing d and the flashover voltage U.

Figure 3:
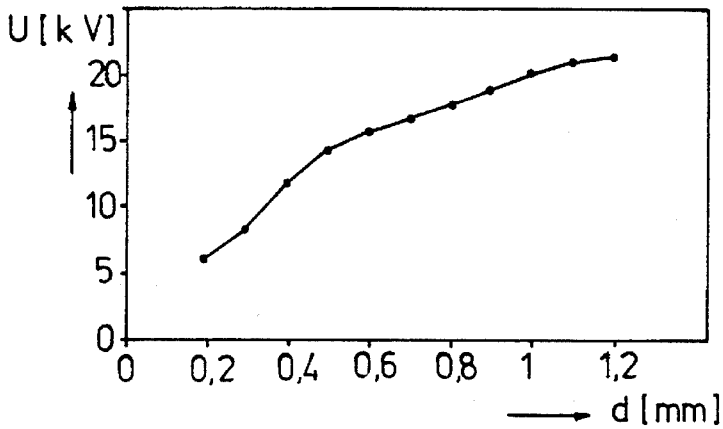

FIG. 3 shows a similar relationship to FIG. 2, for a four-cylinder combustion engine of the type Ford 2274I. In this case, too, a virtually linear relationship between the electrode spacing d and the flashover voltage U can be seen. The measurement results were obtained with the help of a high voltage probe of the type P6015, manufactured by Tektronix.

Figure 4:
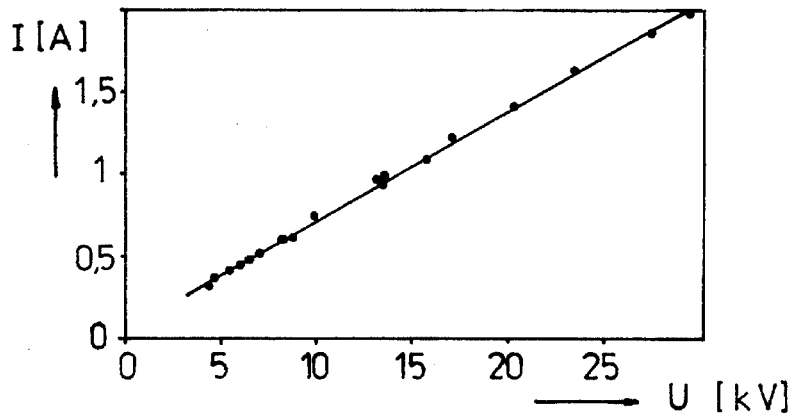

FIG. 4 shows the measured relationship between the peak current I in A (abscissa) and the flashover voltage U in kV (ordinate) for the test cylinder filled with nitrogen. A direct linear relationship (correlation 0.99) between the peak current and the flashover voltage is evident from this diagram.

Figure 5:
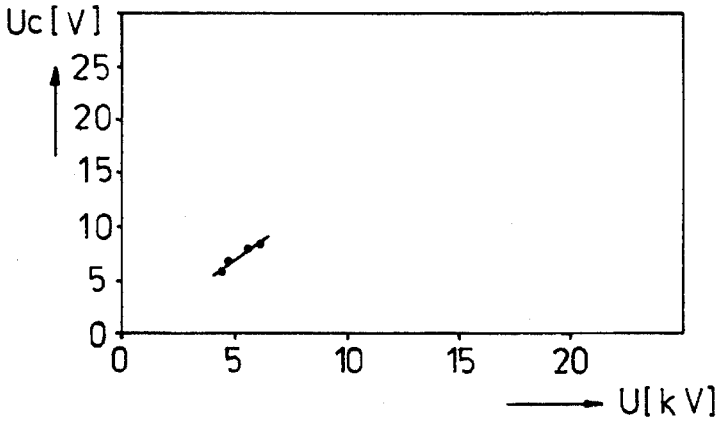
Figure 6:
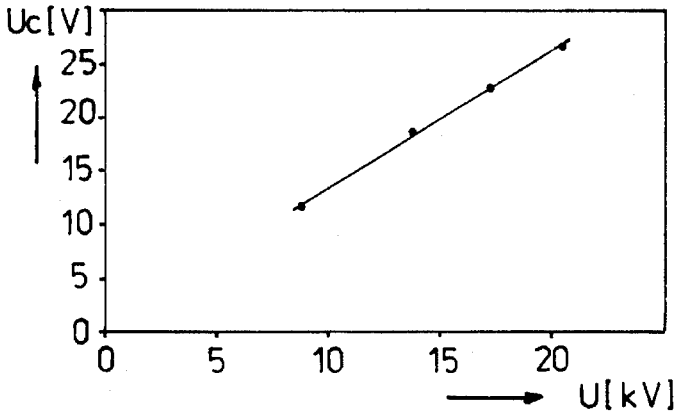

FIGS. 5 and 6 show the relationship, determined using the device according to the invention corresponding to the embodiment as shown in the block diagram of FIG. 1, between the induced voltage $U_c$ in coil 8, in V (abscissa), and the flashover voltage U, in kV (ordinate) in the case of the test cylinder with nitrogen at a pressure of 1 bar (FIG. 5) and 10 bar (FIG. 6). The diagrams show a clearly linear relationship (correlation 0.99) between the voltage $U_c$ generated in coil 8 and the voltage U at which flashover occurs between the electrodes of a spark gap or spark plug.

By combining the FIGS. 5, 6 and 2 it can be clearly seen that the voltage generated in coil 8 is a direct, linear measure of the spacing d between the electrodes of a spark gap or spark plug.

It is clear from the above that it is possible to obtain an accurate measure of the electrode spacing by inductively measuring the current of a spark gap and by suitable processing of these measurement results. It is sufficient to use a commercially available coil as a sensor, while the processing electronics can be produced from relatively cheap components. Of course, the processing circuit is not limited to the embodiment produced and discussed, but can be constructed according to various alternative embodiments which are within the scope of a person skilled in the art. The analyzing circuit 14 can be constructed in the form of a suitably programmed microprocessor, if desired in combination with the memory elements and circuit elements 19, whilst the A/D converter 18 can also be connected directly downstream of the peak-value detector 9, for the purpose of the entirely digital processing of the measuring signals. Although essentially there is no requirement in the case of the method and device according to the invention for the external input or the external establishing of reference data, means suitable for this purpose may be provided, for example a keyboard or the like. Possible applications are the input of type data or the like of the spark gap used.

We claim:

1. Method for monitoring, during operation, the performance of an electrical spark gap, in particular a spark plug of a combustion engine, which is connected to a device for generating electrical high voltage, wherein current arising during the flashover of the spark gap being detecting is converted into a measuring signal representative of the instantaneous operational condition of the spark gap, and analyzed, including the following steps:

establishing reference data representing an initial performance of the spark gap from the measuring signal obtained during an initial measurement and recording the reference data, analyzing the instantaneous measuring signal as a function of the reference data, and signaling discrepancies resulting from the analysis step between the instantaneous measuring signal and the recorded reference data.

2. Method according to claim 1, wherein the reference data are established from a first measurement after installation of the spark gap.

3. Method according to claim 1, wherein the instantaneous measuring signal is analyzed as a function of the operating condition of the spark gap.

4. Method according to claim 3, wherein the spark gap is of a spark plug in a combustion engine and the instantaneous measuring signal is analyzed as a function of engine load by determining, from a measurement of the instantaneous engine load, a parameter by means of which the recorded reference data are selected or converted as a function of the engine load.

5. Method according to claim 3, wherein the spark gap is of a spark plug in a combustion engine and the instantaneous measuring signal is analyzed as a function of engine load by determining, from a measurement of the instantaneous engine load, a parameter by means of which the instantaneous measuring signal is converted to an engine load corresponding to the reference data.

6. Method according to claim 5, wherein the reference data correspond to the zero load condition of the engine.

7. Method according to claim 1, wherein an instantaneous measuring signal is provided which corresponds to the average instantaneous peak value of the current in the spark gap, said spark gap having spaced electrodes, the reference data comprising a value corresponding to the initial electrode spacing of the spark gap, wherein a signal indicative of the deviation of the instantaneous electrode spacing compared to the initial spacing is provided by means of comparing the instantaneous measuring signal and the reference data.

8. Device for monitoring, during operation, the performance of an electrical spark gap, in particular a spark plug of a combustion engine, which is connected to a device for generating electrical high voltage, comprising means for detecting current arising during flashover of the spark gap, said spark gap having spaced electrodes, an electrical processing circuit for converting the detected current into a measuring signal representative of an instantaneous operating condition of the spark gap and means for analyzing the measuring signal, including means for providing reference data representing the performance of the spark gap from an initial measurement, means for recording the reference data, and wherein the means for the analysis of the instantaneous measuring signal is designed for signalling discrepancies between the instantaneous measuring signal and the reference data.

9. Device according to claim 8, comprising means for providing a parameter corresponding to the instantaneous operating condition under which the spark gap operates, which means are coupled to the means for analyzing the instantaneous measuring signal, in order to analyze the instantaneous measuring signal as a function of said parameter.

10. Device according to claim 9, for use in combination with a spark gap in the form of a spark plug of a combustion engine, wherein the means for measuring the instantaneous operating condition provide a parameter corresponding to the instantaneous engine load.

11. Device according to claim 9, wherein the means for measuring the instantaneous operating condition of the spark gap are coupled to the means for recording the reference data, in order to record the reference data in dependence on the parameter corresponding to the instantaneous operating conditions.

12. Device according to claim 8, wherein the means for detecting the current through the spark gap comprise an electrical sensor coupled inductively to a terminal lead of the spark gap, and providing a sensor output signal, the processing circuit comprising, as first stage, a peak-value detector and an integrator in series connection for providing a measuring signal which corresponds to the average instantaneous peak value of the sensor output signal, said measuring signal being in the form of an electrical voltage corresponding to the electrode spacing of the spark gap.

13. Device according to claim 12, wherein the sensor comprises an electrical toroidal coil disposed around the terminal lead.

14. Device according to claim 12, comprising means for providing an analog or digital output signal corresponding to the instantaneous measuring signal, which means are connected to the first stage.

15. Device according to claim 14, comprising means for providing, on the basis of the output signal, a display varying linearly with the electrode spacing.

16. Device according to claim 15, including a monitoring circuit operatively connected to said device producing a signal if the output signal exceeds, or falls below, one or more predetermined values.

17. Device according to claim 8 for monitoring one or more spark plugs in a combustion engine, wherein each spark plug is provided with separate means for detecting the current occurring at flashover of the spark plug and with an electrical processing circuit for providing an instantaneous measuring signal.

* * * * *